United States Patent [19]

Harandi

[11] Patent Number: 5,015,364

[45] Date of Patent: May 14, 1991

[54] METHOD AND MEANS FOR REFINERY GAS PLANT OPERATION

[75] Inventor: Mohsen N. Harandi, Lawrenceville, N.J.

[73] Assignee: Mobil Oil Corporation, Fairfax, Va.

[21] Appl. No.: 369,169

[22] Filed: Jun. 21, 1989

[51] Int. Cl.[5] ..... C10G 29/20

[52] U.S. Cl. ..... 208/236; 208/208 R; 208/254 R; 208/289; 423/229

[58] Field of Search ..... 208/97, 236, 254 R, 208/289, 208 R; 423/229; 585/860

[56] References Cited

U.S. PATENT DOCUMENTS

| | | | |
|---|---|---|---|
| 3,188,287 | 6/1965 | Hull | 208/346 |
| 3,477,946 | 11/1969 | Borst, Jr. | 208/344 |
| 3,574,089 | 4/1971 | Forbes | 208/101 |
| 3,690,816 | 2/1970 | Alleman | 208/236 X |
| 4,212,726 | 7/1980 | Mayes | 208/101 |
| 4,233,141 | 11/1980 | Bearon et al. | 208/236 |
| 4,466,946 | 8/1984 | Goddin, Jr. et al. | 423/228 |
| 4,808,765 | 2/1989 | Pearce et al. | 208/236 X |

*Primary Examiner*—Curtis R. Davis

*Assistant Examiner*—William Diemler

*Attorney, Agent, or Firm*—Alexander J. McKillop; Charles J. Speciale; Laurence P. Hobbes

[57] ABSTRACT

A process is disclosed for operating a refinery gas plant such as the unsaturated gas plant of a catalytic hydrocarbon conversion process that results in a reduction of the corrosive effect of acid gases on the gas plant vessels and equipment. The process comprises contacting acidic hydrocarbon feedstreams to an unsaturated gas plant separator zone with lean acid gas absorbing absorbent in an absorbtion zone comprising at least one liquid absorber bed and one vapor absorber bed. The liquid and vapor absorber beds are located upstream of the separator zone. The feedstreams to the gas plant comprise unstabilized, or wild, liquid gasoline and liquid and vapor output streams from the liquid-vapor separator for inter-stage wet gas compressor of the conversion process main fractionator. Accordingly, these feedstreams are deacidified before separation in the USGP deethanizer-absorber, sponge absorber, and debutanizer. This also eliminates the need for deacidification of the gas plant product stream.

13 Claims, 4 Drawing Sheets

FUEL GAS
SPONGE
LPG TO MEROX
C
DEBUT
C5+
A
DEETH
475
470
465
420
430
425
D
E
F
G
DEA ABS
415
450
460
435
440
410
455
COMP. OUTLET
INTERSTAGE LIQUID
DEA
DEA
WILD GASOLINE

METHOD AND MEANS FOR REFINERY GAS PLANT OPERATION

This invention relates to a process and apparatus for the removal of acidic components from the hydrocarbon feedstream to the unsaturated gas plant of a hydrocarbon catalytic conversion process. More particularly, the invention relates to a method and means for removing such acidic materials by amine absorption upstream of the unsaturated gas plant (USGP) fractionation and absorber operations so as to minimize equipment corrosion and acid gas breakthrough into the gasoline pool.

BACKGROUND OF THE INVENTION

Refinery processes such as hydrocracking, coking and catalytic cracking produce substantial quantities of sour gases which are typically collected in a gas plant such as an unsaturated gas plant (USGP). FIG. 1 presents a typical process schematic for a fluid catalytic cracking plant incorporating USGP and illustrating the particular unsaturated gas plant downstream of the main fluid catalytic cracking (FCC) fractionator. In the FCC process, feed, such as gas oil (20), is heated in a heater (21) and passed to the bottom of the riser section (22) of the catalytic cracking reactor (23) where it comes in contact with the catalyst recirculated from catalyst regenerator (24) at high temperature, where it is cracked to provide an overhead stream (25) while catalyst is recycled through conduits (26,27). The overhead product, after catalyst separation, passes to the main FCC fractionator (19) where it is separated into a gasoline and light gases fraction (18), light fuel oil (28) and heavy fuel oil (29) and a bottoms fraction (30) which may be recycled (31) to the FCC feed. Overhead (18) passes to an accumulator (17) to provide a reflux stream (16) to the main fractionator. Also from the accumulator wet gases are compressed in compressors (15), cooled (31), and passed (32) to a lower section of an absorber/stripper (33). A "wild" or unstabilized gasoline fraction from the accumulator is passed to an upper portion of the absorber/stripper through conduit (34). The absorber/stripper overhead product is light gases and $C_2-$ fraction (35); these are passed sponge to absorber 45 for separation of the $C_2-$ fraction as overhead 46. The bottom fraction is passed (36) to debutanizer (37), where a $C_4-$ overhead is passed to depropanizer (38) to provide a propane and propylene product (39). The debutanizer bottoms effluent comprises a $C_5+$ fraction and is passed through conduit (40) to gasoline splitter (41) to produce a light gasoline fraction (42) and heavy gasoline fraction (43), a portion of which is returned (44) to absorber/stripper (33).

In so far as olefinic gases produced in the typical refinery operations described above generally contain acid gases their removal is conventionally conducted as part of the USGP operations. These acid gases are primarily hydrogen sulfide and carbon dioxide but also include hydrogen cyanide. A large variety of acid gas removal processes are available that separate into processes based upon chemical solvent action including solvents such as monoetholamine (MEA), diethyanolamine (DEA), and hot potassium carbonate; processes depending on physical solvent action such as Selexol, Rectisol, etc.; and processes based on dry adsorbents such as molecular sieves, activated charcoal, iron sponge and the like. Conventionally, in the prior art these acid gas removal processes are installed downstream of the sponge absorber and debutanizer. Consequently, the acid gases are carried through the various upstream separation processes of the USGP including the absorber-deethanizer, sponge absorber and debutanizer. This configuration tends to increase the rate of acid gas induced corrosion of a large portion of the vessels and ancillary equipment in the USGP, leading to increased maintenance operations and plant downtime.

It is an object of the present invention to provide a process for the operation of an USGP in a manner which reduces the corrosive effect of acid gases on plant operations.

Another object of the present invention is to provide a process for the removal of acid gases in the process stream to USGP upstream of USGP gas separation operations.

Yet another object of the present invention is to provide a unique acid gas absorber apparatus design for high recovery USGP operations.

Another objective is to unload or reduce the required total throughput of the unsaturated gas plant.

SUMMARY OF THE INVENTION

A process has been discovered for operating an unsaturated gas plant of a catalytic hydrocarbon conversion process that results in a reduction of the corrosive effect of acid gases on USGP vessels and equipment. The process comprises contacting acidic hydrocarbon feedstreams to an unsaturated gas plant separator zone with lean acid gas absorbing absorbent in an absorbtion zone comprising at least one liquid absorber bed and one vapor absorber bed. The liquid and vapor absorber bed are located upstream of the separator zone. The feedstreams to the USGP comprise unstabilized, or wild, liquid gasoline and liquid and vapor output streams from the liquid-vapor separator for interstage liquids and compressor effluents from said conversion process main fractionator. Accordingly, these feedstreams are deacidified before separation in the USGP.

More particularly, the process comprises combining unsaturated gasoline and liquid output streams and countercurrrently contacting the combined streams with lean absorbent in a liquid absorber bed to produce deacidified liquid hydrocarbon effluent; then passing the hydrocarbon effluent to separator zone. Partially acidified absorbent from the liquid absorber bed is passed to the vapor absorber bed where the vapor output stream is contacted countercurrently with the partially acidified absorbent in the vapor absorber bed to produce deacidified vapor hydrocarbon effluent. The deacidified vapor hydrocarbon effluent is then passed to the separator zone. Rich absorbent is withdrawn from the vapor absorber bed for regeneration.

The novel means of the instant invention comprises an absorber reactor system for deacidifying acidic liquid and vapor hydrocarbon feedstreams to a catalytic hydrocarbon conversion process unsaturated gas plant which includes a first absorber reactor means for deacidifying liquid hydrocarbon feedstream in contact with acid absorbing absorbent fluid. A second absorber reactor means is included for deacidifying vapor hydrocarbon feedstream in contact with acid absorbing absorbent fluid. The second reactor means is receivably connected to receive partially acidified absorbent from the first reactor.

DETAILED DESCRIPTION OF THE INVENTION

The present invention presents an USGP design which minimizes equipment corrosion, slightly unloads the major pieces of USGP equipment and reduces the chance for breakthrough of deleterious sulfur compounds into the gasoline pool by removing hydrogen sulfide, carbon dioxide and hydrogen cyanide upstream of the deethanizer-absorber.

Figure 1:
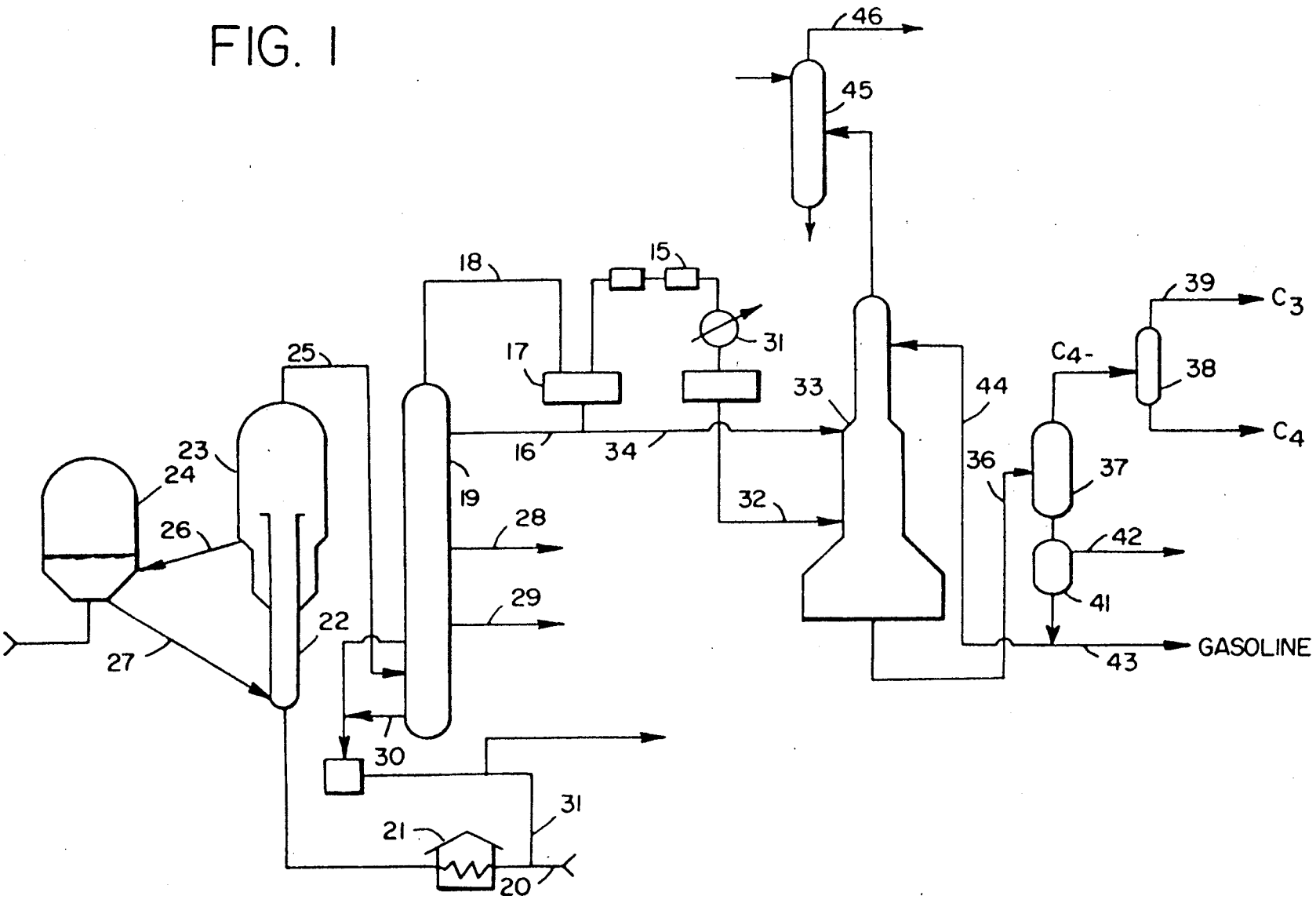
FIG. 1 is a schematic diagram showing prior art process for fluid catalytic cracking which includes an USGP.
Figure 2:
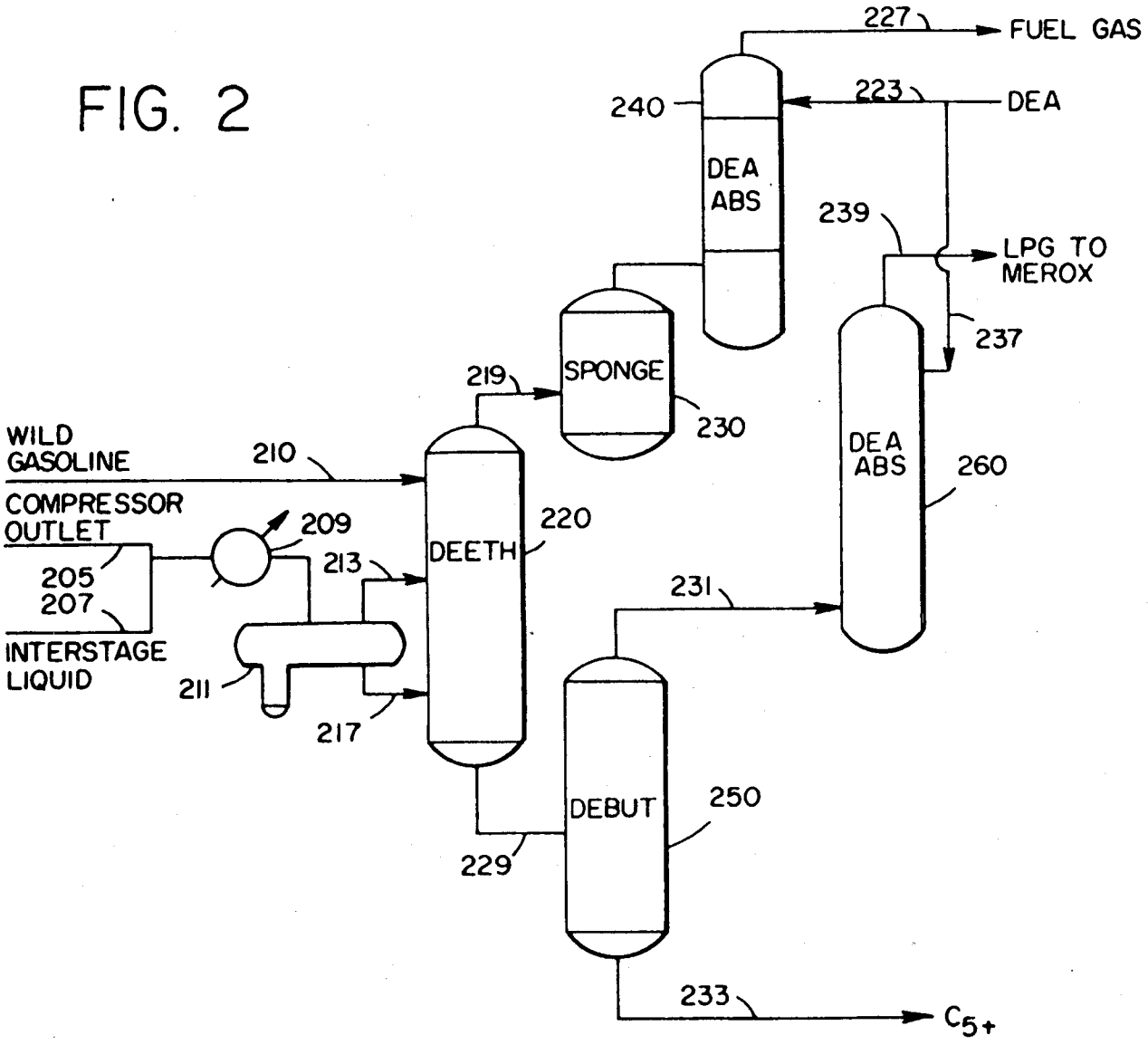
FIG. 2 is a schematic diagram providing a further illustration of a conventional USGP design.

Referring to FIG. 2, a conventional USGP design is presented. The feedstreams to the USGP are principally derived from the main fractionator of the hydrocarbon conversion process and include wild or unstabilized gasoline, the hydrocarbon gases from compressor outlet and interstage liquids. These feedstreams are acidic in nature in that they are relatively rich in acidic gases such as hydrogen sulfide and hydrogen cyanide. Wild or unstabilized gasoline (210) from the hydrocarbon conversion process is passed to an upper portion of a deethanizer-absorber (220). The compressor outlet gases (205) and interstage liquid (207) are cooled (209) and transferred to separator (211). From the separator a vapor stream (213) is transferred to a tray in the midportion of the deethanizer-absorber while a liquid stream (217) is transferred to a lower tray of the deethanizerabsorber. Due to the vapor liquid equilibrium conditions at the top of the deethanizer-absorber a significant amount of lighter hydrocarbons are vaporized from the lean oil introduced into the deethanizer-absorber and leave the top of the column with the residue gas. This material is passed (219) to sponge absorber (230). The light hydrocarbons are transferred (221) as an overhead stream from the sponge absorber (230) to a bottom section of an amine absorber where they are treated for acid gas removal in contact with an amine such as diethanolamine introduced (223) into a top portion of vessel (240). The overhead from vessel (240) is recovered (227) as diacidified fuel gas.

Sufficient reboil is added to the bottom of the stripping section of the absorber-deethanizer (220) to remove at least a portion of absorbed ethane and methane from the bottom liquid product. The deethanized rich oil is then passed (229) to debutanizer (250) where essentially all the recovered $C_3$–$C_4$ are fractionated and removed as overhead product through conduit (231). From the debutanizer a bottom stream (233) comprising $C_5$+ hydrocarbons is recovered. A portion of the $C_5$+ hydrocarbon may be cooled and recycled to the top of the deethanizer-absorber tower as lean oil. The debutanizer overhead (231) is transferred to a bottom portion of another amine absorber (260) wherein acid gases are removed in contact with diethanolamine stream (237). The diacidified overhead stream (239) from amine absorber (260) comprising LPG is recovered and subjected to further desulfurization, such as by Merox process, as appropriate.

In the foregoing conventional USGP design it is obvious that the acid gases contained in the feedstreams are present during the major course of the plant operation in vessels (220), (230), and (250). Accordingly, these vessels and their separation operations are subject to chemically corrosive attack by these gases before their removal in amine absorber vessels (240) and (260).

Figure 3:
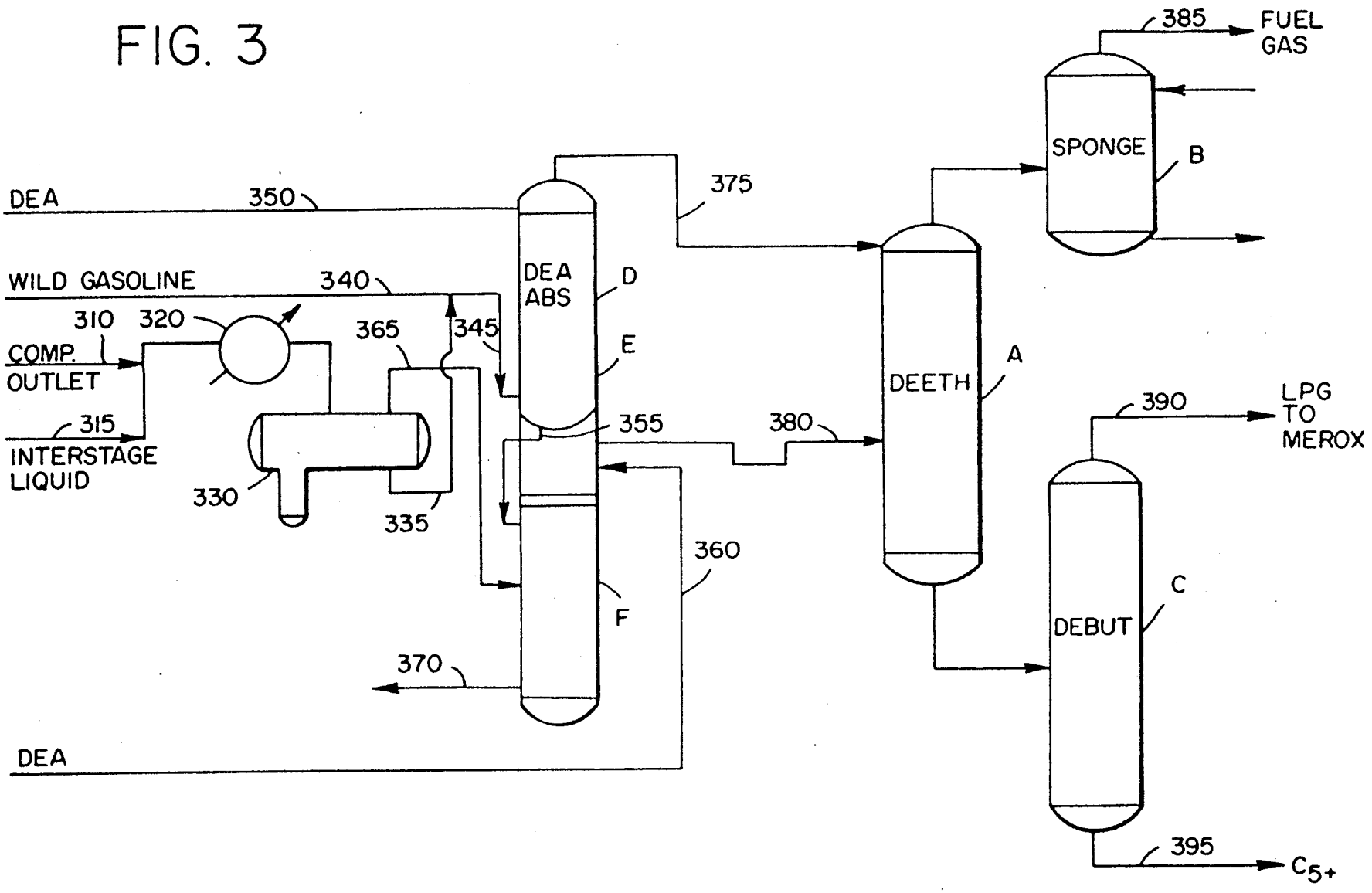
FIG. 3 is a schematic diagram illustrating the USGP design of the present invention.

Referring to FIG. 3, a novel design is presented according to the instant invention for the removal of acid gases in an USGP. In this design the principal separation operations of the USGP represented by deethanizer-absorber zone A, sponge absorber zone B and debutanizer zone C are located downstream of amine absorber operations as opposed to a location upstream as practice in the prior art heretofore. This is achieved by installing diethanolamine absorber D containing two amine absorption zones E and F upstream of the aforestated separation zones. Amine absorption zones E and F are interconnected such that amine can flow from zone E to zone F. In the preferred process compressor outlet gases (310) and interstage liquids (315) are cooled (320) and separated in separator (330). The liquid fraction (335) from separator (330) is mixed with wild gasoline feedstream (340) and the mixture is introduced into a bottom portion of amine absorber zone E in countercurrent flow with a lean diethanolamine (DEA) mixture (350) introduced into a top portion of zone E. Partially spent DEA is passed (355) to an upper portion of zone F in combination with fresh DEA (360). The gaseous fraction (365) is passed to a lower portion of zone F in countercurrent contact with DEA. Rich DEA is withdrawn from a lower portion of zone F. The deacidified wild gasoline stream is passed as an overhead (375) from zone E to an upper portion of absorber deethanizer A. The deacidified vapor fraction is transferred (380) from zone F to a middle portion of deethanizer A. From the deethanizer-absorber a deacidified overhead is treated in sponge absorber B to produce deacidified fuel gas (385). The bottom fraction from zone A is separated in debutanizer C to produce a deacidified LPG (390) as overhead and deacidified $C_5$ hydrocarbons as a bottom fraction (395).

In the design described in FIG. 3, FCC wild gasoline and the high pressure separator liquids are mixed and amine treated upstream of the deethanizer-absorber. Preferably, about 50–80% of the total amine circulation rate is sent to this amine absorber. The deethanizer-absorber vapor feed is then sent to another amine absorber where preferably 20–50% of the total amine circulation rate is fed to the absorber upper tray and the rich amine from the other amine absorber is fed to a few trays below the upper tray. An alternative design places zone F on the cooled compressor interstage vapor and mixes the interstage liquid with the wild gasoline, treating the combined stream in zone E.

Figure 4:
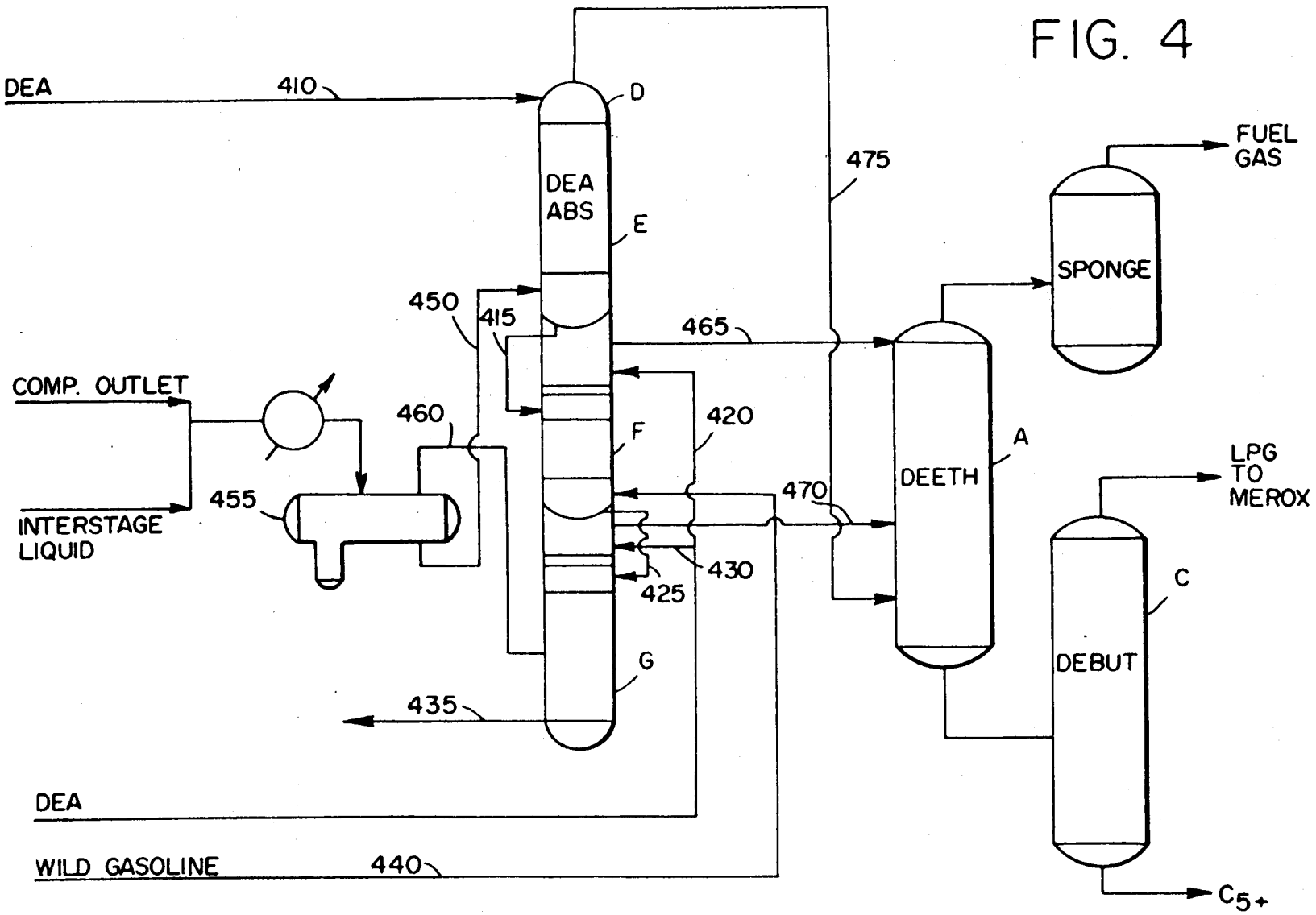
FIG. 4 is a schematic diagram of the instant invention illustrating a higher recovery configuration for an USGP design.

Referring now to FIG. 4, a higher recovery variation of the design of the instant invention is presented. As in the prior embodiment of this invention, the USGP separation zones A, B, and C are located downstream of the DEA amine absorber D. In the instant embodiment, absorber D contains three separate but interconnected amine absorber zones E, F, and G, each of which are fed with a fresh amine stream. Lean DEA is introduced (410) into a top portion of zone B. Partially spent DEA is transferred (415) in conjunction with fresh DEA (420) from a bottom portion of zone E to the top of zone F. From the bottom of zone F partially spent DEA stream and fresh DEA (430) are passed to the top of zone G. Rich DEA is withdrawn from a bottom portion of zone G. Wild gasoline is introduced (440) into the bottom portion of zone F countercurrent to the flow of DEA. The liquid fraction (450) from separator (455) is introduced to the bottom portion of zone E also countercurrent to the flow of DEA while the vapor portion (460) from the separator is passed to the lower portion of zone F.

In FIG. 4, deacidified wild gasoline (465) is withdrawn from a bottom portion of zone E and introduced to a top portion of the deethanizer-absorber zone A. The deacidified vapor fraction is transferred (470) to the mid portion or lower portion of zone A from a bottom portion of zone F while an overhead stream from zone E is introduced into a lower portion of deethanizer-absorber zone A.

As in the prior embodiment, the deacidified effluents from zone A are further treated and separated in sponge absorber B and debutanizer C to produce deacidified fuel gas, deacidified LPG, and deacidified $C_5$ hydrocarbons.

In the foregoing design, FIG. 4, the three deethanizer-absorber feedstreams including the high pressure separator liquid, high pressure separator vapor, and FCC wild gasoline are amine treated in three amine absorbers. In this design the USGP LPG recovery is improved due to higher hydrocarbons partial pressure in the deethanizer-absorber and sponge absorber and deacidification after removing the recoverable acids and $CO_2$.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A process for operating an unsaturated gas plant of a catalytic hydrocarbon conversion process, comprising;

contacting acidic hydrocarbon feedstreams to a gas plant separator zone with lean acid absorbing absorbent in an absorption zone comprising at least one liquid absorber bed and one vapor absorber bed upstream of said separator zone, said feedstreams comprising unstabilized liquid gasoline and liquid and vapor output streams from liquid-vapor separator for inter-stage liquids and compressor effluents from said conversion process main fractionator, whereby said feedstreams are deacidified.

2. The process of claim 1 wherein said separator zone comprises deethanizer zone and debutanizer zone.

3. The process of claim 2 further comprising introducing deacidified liquid and vapor effluent from said absorption zone to said deethanizer zone; and separating an overhead stream comprising deacidified fuel gas and a bottoms stream comprising deacidified LPG and $C_5$+ hydrocarbons.

4. The process of claim 3 further comprising, passing said deacidified LPG and $C_5$+ hydrocarbons to debutanizer zone; and separating an overhead stream comprising LPG and a bottoms stream comprising $C_5$+ hydrocarbons.

5. The process of claim 1 further comprising;

(a) combining said unstabilized gasoline and said liquid output stream and countercurrrently contacting combined streams with said lean absorbent in said liquid absorber bed to produce deacidified liquid hydrocarbon effluent;

(b) passing step (a) hydrocarbon effluent to said saparator zone;

(c) passing partially acidified absorbent from said liquid absorber bed to said vapor absorber bed;

(d) contacting said vapor output stream countercurrently with said partially acidified absorbent in said vapor absorber bed to produce deacidified vapor hydrocarbon effluent;

(e) passing step (d) vapor hydrocarbon effluent to said separator zone;

(f) withdrawing rich absorbent from said vapor absorber bed.

6. The process of claim 5 wherein fresh, lean absorbent is mixed with step (c) partially acidified absorbent.

7. The process of claim 1 wherein said absorption zone comprises a first and second liquid absorber bed and a vapor absorber bed.

8. The process of claim 7 further comprising;

deacidifying said liquid output stream in said first absorber bed in countercurrent contact with said lean absorbent;

passing partially acidified absorbent from said first bed to said second bed and deacidifying said gasoline therein in countercurrent contact with said partially acidified absorbent and fresh, lean absorbent;

passing partially acidified absorbent from said second bed to said vapor bed and deacidifying said vapor output therein in countercurrent contact with said partially acidified absorbent and fresh, lean absorbent;

passing deacidified liquid output stream, gasoline stream and vapor stream from said absorption zone to said separator zone.

9. A method for deacidifying acidic liquid and vapor hydrocarbon feedstreams to a catalytic hydrocarbon conversion process unsaturated gas plant, comprising:

contacting said liquid feedstreams in an absorber bed with acid absorbing absorbent in countercurrent flow;

withdrawing deacidified liquid feedstreams and passing said deacidified liquid feedstreams to said unsaturated gas plant deethanizer-debutanizer separator zone;

contacting said vapor feedstream in an absorber bed with acid absorbing absorbent in countercurrent flow;

withdrawing deacidified vapor feedstream and passing said deacidified vapor feedstream to said unsaturated gas plant deethanizer-debutanizer separator zone.

10. The method of claim 9 further comprising passing partially acidified absorbent from said liquid feedstreams absorber bed to said vapor feedstream absorber bed in combination with acid-lean absorbent; and withdrawing acidrich absorbent therefrom.

11. The method of claim 9 wherein said acidic liquid and vapor hydrocarbon feedstreams comprise unstabilized liquid gasoline, plus the liquid and vapor output streams from a liquid-vapor separator of the cooled and combined streams comprising inter-stage liquid and the compressor effluent from said conversion process main fractionator.

12. The method of claim 9 wherein said absorbent is diethanolamine.

13. The process of claim 1 wherein said lean absorbent comprises fresh absorbent.

* * * * *